US006149499A

United States Patent [19]

Sudou

[11] Patent Number: 6,149,499

[45] Date of Patent: Nov. 21, 2000

[54] POLISHING APPARATUS AND POLISHING METHOD

[75] Inventor: Masaaki Sudou, Yokohama, Japan

[73] Assignee: Kabushiki Kaisha Toshiba, Kawasaki, Japan

[21] Appl. No.: 09/263,875

[22] Filed: Mar. 8, 1999

[30] Foreign Application Priority Data

Mar. 27, 1998 [JP] Japan ..... 10-081634

[51] Int. Cl.[7] ..... B24B 1/00

[52] U.S. Cl. ..... 451/41; 451/207; 451/288; 451/388; 451/390

[58] Field of Search ..... 451/41, 285–289, 451/388, 390, 398

[56] References Cited

U.S. PATENT DOCUMENTS

| | | | |
|---|---|---|---|
| 5,205,082 | 4/1993 | Shendon et al. . | |
| 5,584,751 | 12/1996 | Kobayashi et al. | 451/287 |
| 5,762,539 | 6/1998 | Nakashiba et al. | 451/388 |
| 6,019,670 | 2/2000 | Cheng et al. | 451/288 |
| 6,019,868 | 2/2000 | Kimura et al. | 451/287 |
| 6,024,630 | 2/2000 | Shendon et al. | 451/388 |

FOREIGN PATENT DOCUMENTS 8-11055 1/1996 Japan .

9-168964 6/1997 Japan .

OTHER PUBLICATIONS

Naoto Miyashita, et al., "The Current State of Processing and Problems of Chemical–Mechanical Polishing on the Semiconductor Device Manufacturing," Journal of the Japan Society for Precision Engineering, vol. 62, No. 4, (1996), pp. 491–495.

*Primary Examiner*—David A. Scherbel
*Assistant Examiner*—G. Nguyen
*Attorney, Agent, or Firm*—Oblon, Spivak, McClelland, Maier & Neustadt, P.C.

[57] ABSTRACT

A polishing apparatus comprises holding means for holding an object with the surface to be polished being exposed, first driving means for pressing the holding means against the polishing cloth with variable pressing force and rotating the holding means. It also comprises a guide ring body, provided around the holding means and independent of rotation of the holding means, a lower end of the guide ring body being brought into contact with the polishing cloth. It further comprises second driving means for pressing the guide ring body against the polishing cloth with variable pressing force and rotating the guide ring body independent of rotation of the holding means.

6 Claims, 4 Drawing Sheets

PRESSING FORCE OF GUIDE RING 29.4KPa·ROTATION RATE 70rpm

PRESSING FORCE OF GUIDE RING 29.4KPa·ROTATION RATE 100rpm

PRESSING FORCE OF GUIDE RING 34.3KPa·ROTATION RATE 100rpm

POLISHING APPARATUS AND POLISHING METHOD

BACKGROUND OF THE INVENTION

The present invention relates to a polishing apparatus and a polishing method for polishing a semiconductor wafer flat like a mirror, particularly to a polishing apparatus.

In recent years, as the integration density of a semiconductor wafer is increased, circuit wires become finer, the distance between wires becomes smaller, and the number of wiring layers increases. For this reason, the semiconductor wafer and wiring layers are required to be flat. To efficiently flatten semiconductor wafers, the CMP (chemical mechanical polishing) method is applied.

FIG. 4 shows a schematic diagram showing a polishing apparatus used to perform polishing by the CMP method.

A polishing apparatus 1 comprises a carrier 3 for holding a work 2 such as a semiconductor wafer, a rotation motor (not shown) for rotationally driving the carrier 3, an air cylinder 6 for pressing the carrier 3 and a drive motor 4 against a table 5 (referred to later), the table 5 opposite to the carrier 3, a polishing cloth 7 as a polisher made of nonwoven fabric or expanded polyurethane and provided on the table 5, and the drive motor 4 for rotationally driving the table 5.

A polishing solution containing suitable abrasive grains and chemical liquid is supplied to a portion between the polishing cloth 7 and the work 2, so that the work 2 can be polished to a desired work accuracy.

The work 2 is held by that surface of the carrier 3 opposite to the upper surface of the table 5. The periphery of the work 2 is held by a guide ring to prevent the work 2 from moving off the carrier 3 during the polishing process.

The work 2 can be held by the carrier 3 by various methods. For example, the work 2 can be adhered to the carrier 3 by vacuum; adhered by wax applied to the carrier 3; or fixed by water on a soft film provided on the carrier 3. In the state where the work 2 is adhered to the carrier 3, the carrier 3 and the table 5 are rotated by the drive motor 4 and pressing force is applied to the work 2 by the air cylinder 6. As a result, the irregularities on a surface of the work 2 to be polished can be removed by both the physical function of the grains and the chemical function of the liquid contained in the polishing solution, thereby finishing the surface to a flat face.

If there is no change in polishing environment of the polishing cloth 7 or the polishing solution, the amount of removed part of the work can be determined by the polishing pressure, the relative speed between the work 2 and the polishing cloth 7 and the period of polishing time. Therefore, if the work 2 has a particularly rugged portion, it is necessary to increase the pressure applied to the rugged portion, the relative speed between the work 2 and the polishing cloth 7, or the polishing time.

However, the polishing environment of the polishing cloth 7 or the polishing solution is not constant. In particular, the polishing cloth 7 is worn in accordance with an increase in the period of polishing time and the number of times of polishing. This changes the characteristics of the polishing cloth 7 or the polishing solution, such as the elasticity coefficient and the ability of maintaining polishing grains, which influence the polishing and removing rate and the pressure. Therefore, in the polishing apparatus 1, the most worn portion of the polishing cloth 7 is on a rotation trail in a central portion of the work 2, where the polishing period of time per unit area is the longest. For this reason, if the carrier has the only one shape determined under specific conditions, once the polishing environment is changed, the work 2 cannot be polished precisely flat.

To solve this problem, various methods have been proposed. In one method, the flatness of the work is monitored while polished, and the polishing conditions are changed in accordance with a change in polishing environment during the polishing process. In another method, the shape of the carrier 3 is changed during the polishing process in accordance with the polishing state, so as to adjust the dimensions of the carrier 3.

However, even when the polishing conditions or the shape of the carrier 3 is changed in accordance with the change in polishing environment as described above, a turned-down edge (a phenomenon in which an edge portion of the work 2 is thinned) may occur, resulting in reduction of the flatness of the work 2.

As described above, the problem in an inner portion of the work 2, other than the edge portion, is overcome by optimizing the shape of the carrier to change the pressing force applied to the work 2. However, since the aforementioned turned-down edge results from a problem of the pressure distribution in a peripheral portion of the work 2, it cannot be overcome only by optimizing the shape of the carrier.

FIG. 5 schematically shows a status of a pressure generated in a peripheral portion of the work 2. In this portion, a synthetic pressure is generated by synthesis of a pressing force generated by pressing the work 2 against the polishing cloth and a pressure (hereinafter referred to as a dynamic pressure) generated by relative movement between the work 2 and the polishing cloth 7 (movement obtained by synthesizing rotation of the table 5 and the rotation of the work 2 held by the polishing apparatus 1).

For this reason, the pressure in the peripheral portion of the work 2 is adjusted by the guide ring 8 provided to prevent the work 2 from moving. To suppress the dynamic pressure, it is only necessary to optimize the height of the guide ring 8. However, due to a change in polishing environment, as in the case of changing the shape of the carrier, the optimal effect cannot be maintained only by adjusting the height of the guide ring 8.

To solve this problem, according to the method disclosed in Jpn. Pat. Appln. KOKAI Publication No. 9-168964, a press load of the guide ring 8 on the polishing cloth 7 can be varied independent of that of the carrier 3, so that the press load of the guide 8 can be greater than that of the carrier 3.

However, when the press load of the guide ring 8 is increased, the amount of the polishing solution supplied to that portion of the work 2 under polishing is reduced, since the supply of the solution is cutoff by the guide ring 8. As a result, the polishing rate is lowered, inevitably reducing the production yield of works 2.

Further, Jpn. Pat. Appln. KOKAI Publication No. 8-11055 discloses a structure in which a guide ring 8 has a number of grooves arranged at intervals to satisfactorily supply the polishing liquid to a work 2 held by the carrier 3. However, according to the technique disclosed in this reference, a holding portion holding a work 2 is formed integral with the guide ring 8. Hence, the position of the grooves relative to the work 2 cannot be changed. For this reason, in a peripheral portion of the work 2, the pressing force varies depending on ruggedness due to the grooves, and influences the work 2. Therefore, the work 2 cannot be polished flat in the peripheral portion.

BRIEF SUMMARY OF THE INVENTION

The present invention has been made in consideration of the above matters, and its object is to provide a polishing apparatus and polishing method which can prevent occurrence of a turned-down edge on a surface to be polished in a peripheral portion of a semiconductor wafer, so that the surface can be polished flat.

According to the present invention, there is provided a polishing apparatus for polishing an object by pressing the object against a polishing cloth arranged opposite to a surface of the object to be polished and attached to an upper surface of a table, the apparatus comprising:

a holder for holding the object with the surface to be polished being exposed;

a first driver for pressing the holder against the polishing cloth with variable pressing force and rotating the holder;

a guide ring body, provided around the holder and rotated independent of the holder, a lower end of the guide ring body being brought into contact with the polishing cloth; and a second driver for pressing the guide ring body against the polishing cloth with variable pressing force and rotating the guide ring body independent of rotation of the driver.

There is also provided a polishing method for polishing an object held by a holder comprising the steps of: pressing the object against a polishing cloth arranged opposite to a surface of the object to be polished; and rotating the holder relative to the polishing cloth, wherein a guide ring body, provided around the holder, pressed independent of the holder, has a lower end brought into contact with the polishing cloth at intervals, and rotated at a rotation rate different from that of the holder.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described with reference to FIGS. 1 to 3.

Figure 1:
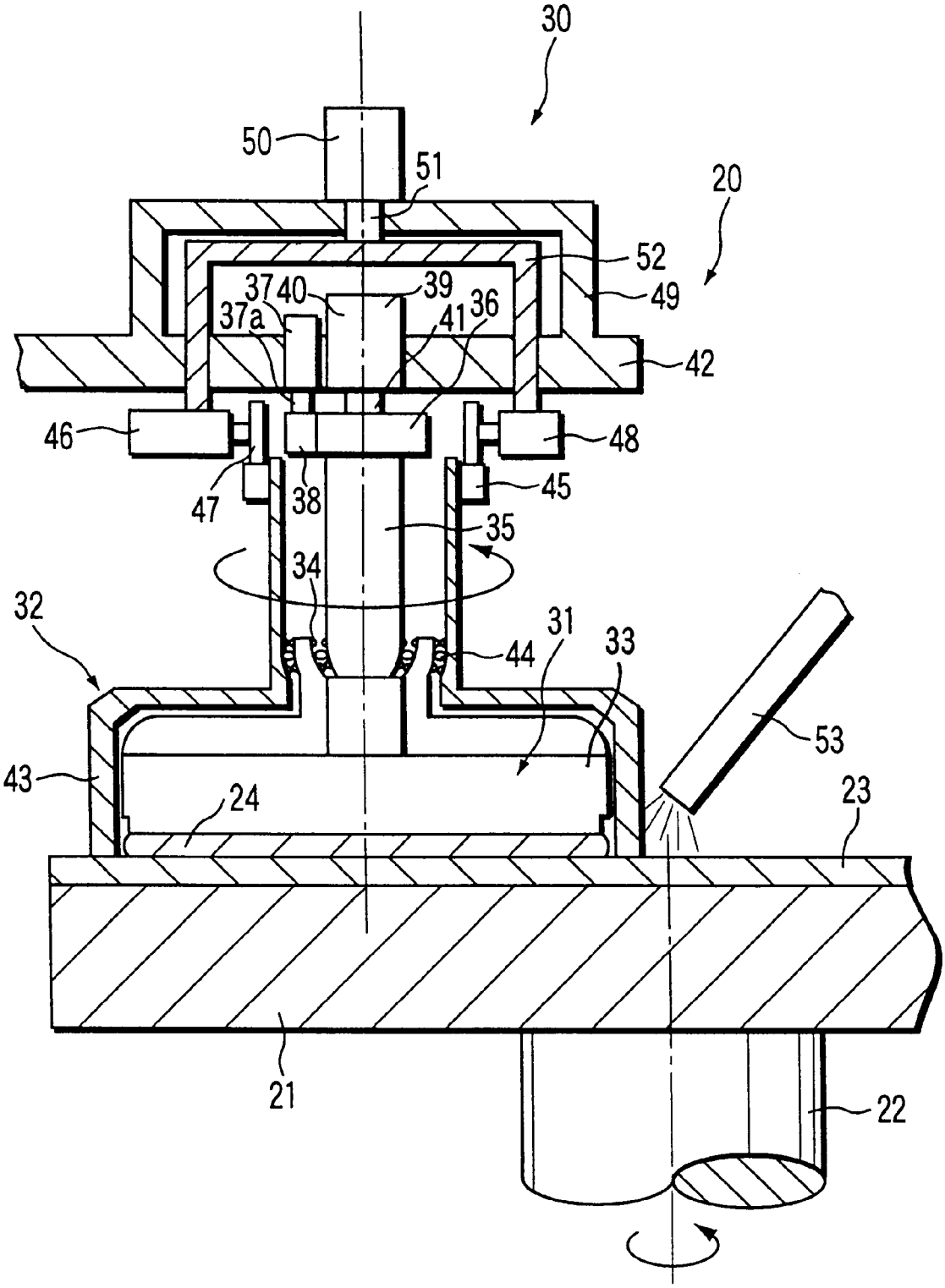
FIG. 1 is a vertical cross-sectional view of a polishing apparatus according to an embodiment of the present invention.

A polishing apparatus 20 shown in FIG. 1 comprises a table 21. The upper surface of the table 21 is flat. A rotation shaft 22, for rotating the table 21, is integrally attached to a central portion in the diametric direction of the lower surface of the table. The rotation shaft 22 is connected to a drive source (not shown), so that a polishing cloth 23 attached to the upper surface of the table 21 can be rotated to polish a work 24.

The upper surface of the polishing cloth 23 attached to the upper surface of the table 21 is accurately flat in order to polish the work 24 (a semiconductor wafer).

A work rotation driver 30 is provided facing the polishing cloth 23. It has a rotational diameter smaller than the diameter of the polishing cloth 23. The work rotation driver 30 comprises a carrier mechanism portion 31 for holding and rotating the work 24 and a guide ring mechanism portion 32 which is rotatable and located around the periphery of the carrier mechanism portion 31.

The carrier mechanism portion 31 has a carrier 33 for holding the work 24 such that the surface to be polished faces the polishing cloth 23. A rotation shaft 35 is connected to an upper portion of the carrier 33 via bearings 34. A rotational drive gear 36 is attached to a top end portion of the rotation shaft 35, and engaged with a drive gear 38 attached to a drive shaft 37*a* of a drive motor 37. With this structure, drive force generated by the drive motor 37 is transmitted to the rotation shaft 35.

Above the drive gear 38, an air cylinder 39 for pressing the work 24 held by the carrier 33 is attached to the rotation shaft 35. The air cylinder, comprising a cylinder body 40 and a rod body 41, applies pressing force to the rotation shaft 35 by air pressure. When the rotation shaft 35 receives the pressing force, it is driven downward, with the result that pressing force is applied to the work 24.

The drive motor 37 and the air cylinder 39 are both attached to a support arm 42. The support arm 42 is made of, for example, a rod member or a plate member, and constructed to easily apply driving force and pressing force to the drive motor 37 and the air cylinder 39.

The carrier mechanism 31 described above is covered by the guide ring mechanism portion 32. The guide ring mechanism portion 32 has a guide ring 43 shaped like a cylindrical case. The guide ring 43 covers the carrier 33 and the rotation shaft 35. The guide ring 43 is supported by the rotation shaft 35 via bearings 44 provided in a portion of the rotation shaft 35 near the carrier 33.

The guide ring 43 is arranged in proximity to and no contact with the carrier 33. The upper end of the guide ring 43 has an opening of a diameter corresponding to the rotation shaft 35 and is engaged with a rotation drive gear 45. A drive gear 47 connected to a drive motor 46 is engaged with the rotation drive gear 45. The engagement of the drive gear 47 and the rotation drive gear 45 constitutes, for example, a bevel gear.

Auxiliary rotation gears 48 as well as the drive motors 46 are engaged with the rotation drive gear 45. The auxiliary rotation gears 48 are arranged at, for example, three portions of the rotation drive gear 45 including the drive motors 46. It applies pressing force to the guide ring 43 via the drive motors 46 and the auxiliary rotation gear 48.

To apply pressing force to the guide ring 43, an air cylinder 50 is attached to a branch arm portion 49 of the support arm 42. A support member 52 is attached to the lower end of a rod 51 of the air cylinder 50. The drive motor 46 and the auxiliary rotation gear 48 are attached to the lower end of the support member 52. With this structure, when the air cylinder 50 is operated to provide pressing force downward, the pressing force is applied to the guide ring 43 via the support member 52, the drive gear 47 of the drive motor 46 and the auxiliary rotation gear 48.

Figure 2A:
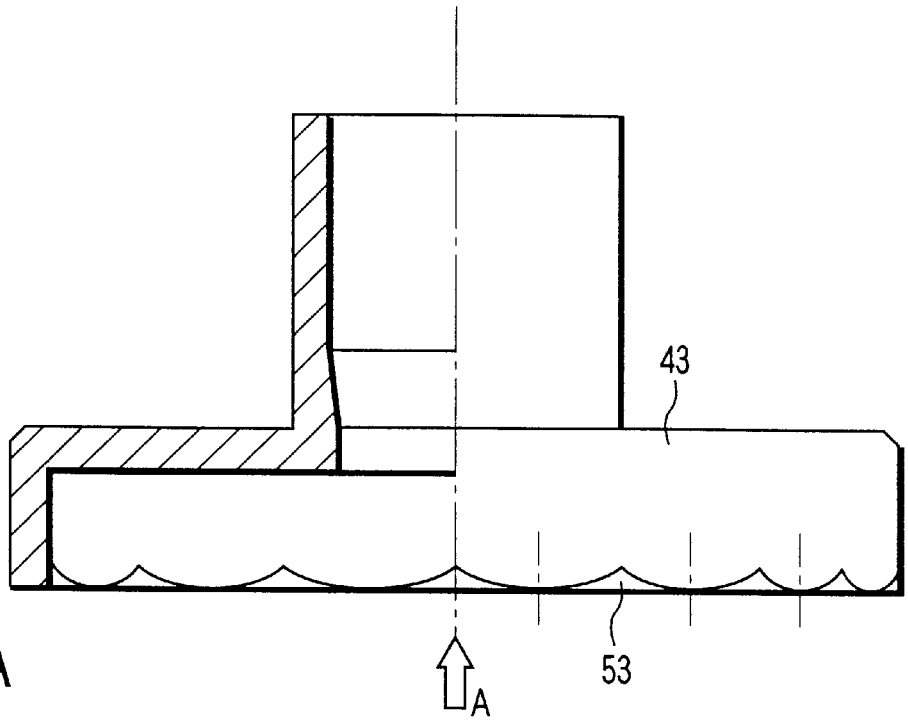
FIGS. 2A and 2B are diagrams showing a shape of the guide ring shown in FIG. 1.
Figure 2B:
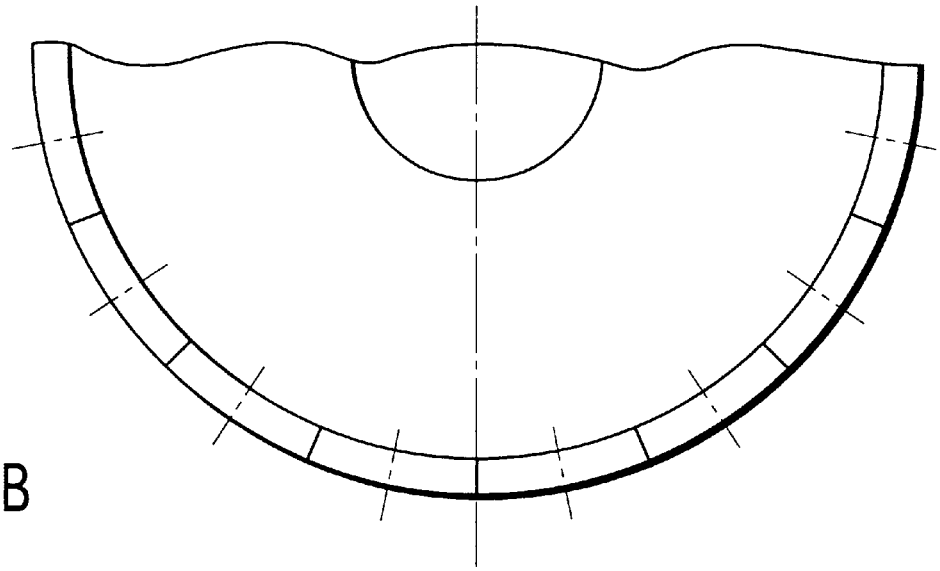

As shown in FIG. 2A, the lower end face of the guide ring 43 is formed of a number of substantially arc-shaped curves, so as to form spaces 53 arranged at intervals between the lower end face and the polishing cloth 23 in contact thereto.

A supply nozzle 54 is arranged above the polishing cloth 23 to supply a polishing solution to the polishing cloth 23 on the table 21.

An operation of polishing the work 24 using the polishing apparatus 20 of the above structure will now be described.

The work 24 is fixed to the carrier 33 by, for example, vacuum absorption, and pressed with suitable pressure against the polishing cloth 23 on the table 21. As the polishing solution is supplied through the supply nozzle 54, the table 21 and the carrier 33 holding the work 24 are rotated, and further the guide ring 43 is rotated independent of the carrier 33, while the work 24 is polished.

In this case, the rotation rate of the guide ring 43 is set higher than that of the carrier 33. The pressing force of the guide ring 43 against the polishing cloth 23 is set higher than that of the carrier 33 against the polishing cloth 23.

Figure 3A:
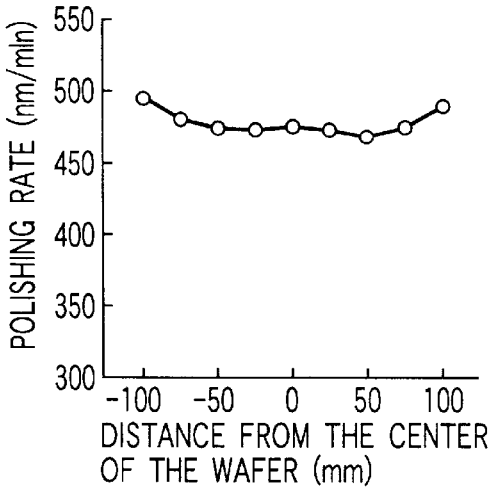
FIGS. 3A to 3C are graphs showing the relationship between the distance from the center of a work and the polishing rate.
Figure 3B:
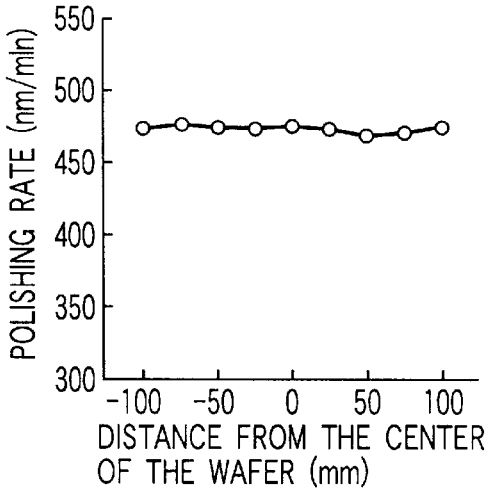
Figure 3C:
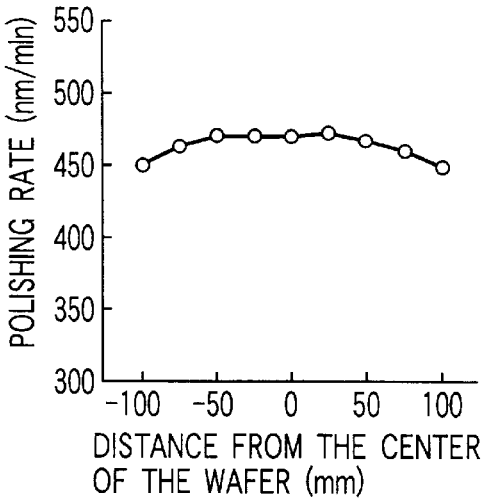
Figure 4:
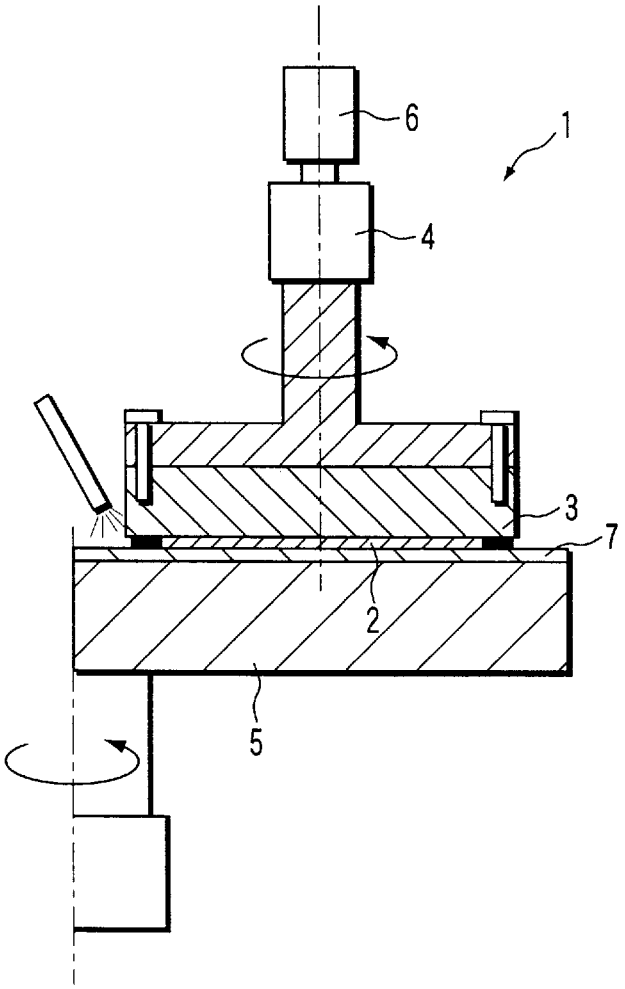
FIG. 4 PRIOR ART
FIG. 4 is a vertical cross-sectional view of a conventional polishing apparatus.
Figure 5:
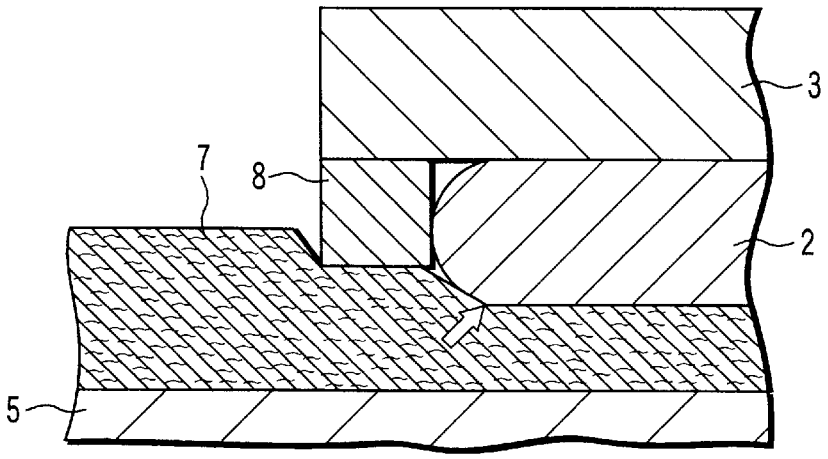
FIG. 5 PRIOR ART
FIG. 5 is a diagram showing a work polished by the polishing apparatus shown in FIG. 4.

FIGS. 3A to 3C show polishing states under these conditions.

The graph of FIG. 3A shows the relationship between the distance from the center of a work 24 and the polishing rate, in a case where the pressing force of the guide ring 43 is 29.4 KPa and the rotation rate thereof is 70 rpm. The graph of FIG. 3B shows the relationship therebetween, in a case where the pressing force of the guide ring 43 is 29.4 KPa and the rotation rate thereof is 100 rpm. The graph of FIG. 3C shows the relationship therebetween, in a case where the pressing force of the guide ring 43 is 34.3 KPa and the rotation rate is 100 rpm.

In all the above cases, the pressing force of the carrier 33 is 29.4 KPa and the rotation rate thereof is 70 rpm.

As is understood from the graph of FIG. 3A, when the rotation speed of the guide ring 43 is 70 rpm, the polishing rate in an edge portion of the work 24 is greater than that in a central portion thereof. When the rotation rate of the guide ring 43 is low as in this case, the elasticity recovery rate of the polishing cloth 23 is accordingly low. Thus, as the pressing force on the edge portion of the work 24 is great, the polishing rate in the edge portion of the work 24 is also great. For this reason, the work 24 cannot be polished uniformly in the inner portion and the edge portion.

When the pressing force of the guide ring 43 is 34.3 KPa as shown in FIG. 3C, the polishing rate in the edge portion of the work 24 is lower than that in the edge portion thereof. Thus, in this case also, the work 24 cannot be polished uniformly in the inner portion and the edge portion.

Therefore, the pressing force of the guide ring 43 is set as shown in the graph of FIG. 3B, such that the same pressing force is applied to both the inner portion and the edge portion of the work 24, and the rotation rate of the guide ring 43 is set to a predetermined value greater than that of the carrier 33. In this case, the pressing force on the work 24 can be regulated, with the result that the polishing surface of the work 24 can be processed to be flat.

With the polishing apparatus having the above structure, driving force and pressing force are applied to the carrier 33 respectively by the drive motor 37 and the air cylinder 39. The driving force and pressing force are applied to the guide ring 43 respectively by the drive motor 46 and the air cylinder 50. Thus, the driving force and the pressing force are supplied to the carrier 33 and the guide ring 43 independently. Therefore, the pressing force can be regulated such that uniform pressing force can act on the inner portion and the edge portion of the work 24. Further, the rotation rates of the carrier 33 and the guide ring 43 can be independently regulated. Consequently, the work 24 can be flattened uniformly both in the inner portion and the edge portion without unevenness in thickness, preventing occurrence of a turned-down edge.

Moreover, since the lower end of the guide ring has substantially arc-shaped curves to form the spaces 53, the supply of the polishing solution to the polishing surface of the work 24 can be maintained through the spaces between arc-shaped curves. Therefore, the work polishing rate is not lowered, and accordingly the efficiency of polishing work 24 is not lowered. Thus, the production yield of the works 24 can be increased.

Furthermore, since the rotation rate of the guide ring 43 is greater than that of the carrier 33, the recovery of elasticity of the polishing cloth 23 can be suppressed, thereby preventing adverse influences on the edge portion of the work 24, such as a turned-down edge.

Further, the spaces 53 can be greater by increasing the rotation rate. In this case, the polishing solution can be maintained to a sufficient amount.

The present invention is not limited to the embodiment as described above, but can be modified variously, for example, as follows.

In the above embodiment, the spaces 53 are defined by the lower end of the guide ring 43, having substantially arc-shaped curves. However, to form spaces 53, the lower end of the guide ring 43 is not limited to this shape, but can be any shape, for example, a wave shape, a non-linear-curved shape, linear-lined-steps shape, and so on.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A polishing apparatus for polishing an object said apparatus comprising:

a polisher attached to a table;

a holder for holding the object;

a first driver for pressing the holder against the polisher with a variable pressing force and rotating the holder;

a guide ring body, provided around the holder and rotated independently of the holder, the guide ring body having a lower end; and a second driver for pressing the guide ring body against the polisher with a variable pressing force and separately rotating the guide ring body relative to the rotation of the holder.

2. The polishing apparatus according to claim 1, wherein the lower end of the guide ring body is with a space at internal in order to pass a polishing solution.

3. The polishing apparatus according to claim 1, wherein the guide ring body is pressed at pressure greater than that of the holder.

4. A polishing method for polishing an object held by a holder comprising the steps of: pressing the object against a polisher arranged opposite to a surface of the object to be polished; rotating the holder relatively to the polisher; and rotating a guide ring body, the guide ring body, which has a lower end with a space arranged in order to pass a polishing solution, being provided around the holder, and being rotated at a rotation rate different from that of the holder.

5. The polishing method according to claim 4, wherein the rotation rate of the guide ring body is greater than that of the holder.

6. The polishing method according to claim 4, wherein the guide ring body is pressed at pressure greater than that of the holder.

* * * * *